United States Patent [19]

Doepel

[11] 4,362,493

[45] * Dec. 7, 1982

[54] APPARATUS FOR COMPRESSING TABLETS

[76] Inventor: Wallace A. Doepel, 226 Bellino Dr., Pacific Palisades, Calif. 90272

[ * ] Notice: The portion of the term of this patent subsequent to Sep. 29, 1998, has been disclaimed.

[21] Appl. No.: 257,922

[22] Filed: Apr. 27, 1981

Related U.S. Application Data

[62] Division of Ser. No. 167,267, Jul. 9, 1980, Pat. No. 4,292,017.

[51] Int. Cl.[3] ..... B30B 11/08; B30B 15/00

[52] U.S. Cl. ..... 425/345; 425/405 R

[58] Field of Search ..... 425/345, 405 R

[56] References Cited

U.S. PATENT DOCUMENTS 3,599,578 8/1971 Sato ..... 425/345 X

OTHER PUBLICATIONS

The Arthur Colton Co. Brochure for Tablet Press 232.

*Primary Examiner*—J. Howard Flint, Jr.

*Attorney, Agent, or Firm*—Thomas H. Murray

[57] ABSTRACT

High-speed, rotary tablet-forming apparatus wherein dies are filled with product material to be compressed on one turntable and are thereafter transferred to one or more turntables where the said product material is formed into tablets between upper and lower punches. The dies are then returned to the filling table in a closed-loop arrangement. Vacuum is introduced under empty dies on the filling turntable to facilitate rapid filling and elimination of tablet capping and laminating. Further means are provided for direct-die lubrication, eliminating the need for incorporating a lubricant into the product itself, to further enhance cohesiveness of materials being compressed and increase the life of the punches and dies involved.

5 Claims, 10 Drawing Figures

APPARATUS FOR COMPRESSING TABLETS

This is a continuation of application Ser. No. 167,267, filed July 9, 1980, now U.S. Pat. No. 4,292,017.

BACKGROUND OF THE INVENTION

As is known, conventional rotary tablet-making machines comprise a rotary turntable which carries near its periphery an annular series of die cavities in which the dies are clamped. Above and below the die turntable are upper and lower punches carried for rotation with the turntable, there being one upper and one lower punch for each die cavity. The heads of the punches may be guided by raising and lowering camming surfaces to control their reciprocating movements into or out of the die cavities as the die turntable rotates through filling, weight adjusting, compression and ejection stations all spaced around the single turntable.

The production rate of a prior art machine of the type described above is limited by the diameter of the rotary die turntable and its speed of rotation. Furthermore, such presses have relied upon gravity feed of free-flowing materials in order to obtain uniform tablet weight, hardness and size. The gravity flow system often affects the mechanical production rate of the tablet press, the tablet weights, hardness, friability and resultant disintegration time. Furthermore, prior art tablet presses utilizing the aforesaid type die turntable generally require that a lubricant be mixed into the product to be compressed. This is sometimes undesirable and sometimes affects the ultimate efficacy of ingredients such as those found in pharmaceuticals, as well as requiring higher pressures to overcome the lack of cohesiveness caused by the addition of lubricant to the product itself. Prior art tablet presses also use close-tolerance bores to guide the upper and lower punches which are actuated by raising and lowering cams. Unless cleanliness and lubrication of the cams and punches are scrupulously observed, stickiness, gumming, binding and scoring of these parts occur; and the punches must be removed frequently for cleaning and relubricating.

SUMMARY OF THE INVENTION

In accordance with the present invention, new and improved high-speed, tablet-forming apparatus is provided wherein filling of the dies occurs on one turntable, the filled dies being transferred to one or more other turntables where the product material is compressed into tablets by upper and lower punches. The turntables, which lie in an essentially common plane, rotate about parallel axes and are provided on their peripheries with generally semicircular notches for receiving and locating the dies. Apparatus in the form of idler wheels is provided for transferring filled dies from the filling table to the pressing table. After being transferred, the filled dies, carried in the aforesaid semicircular notches, travel around the axis of the pressing table; while upper and lower punch sets compress the product material in each die and eject the formed tablet. Continued travel of the dies in a pressing turntable brings them in succession to a second idler wheel where they are transferred back to the filling turntable. A plurality of pressing turntables, each provided with upper and lower punch sets, can be spaced around the filling turntable such that dies from one pressing turntable return to the filling turntable, then travel to a second pressing turntable and back to the filling turntable, and then travel to possibly a third pressing turntable, and so on.

An important feature of the invention resides in the provision of means for creating a vacuum under the empty dies on the filling turntable during the filling operation. This facilitates faster filling than is possible with prior art gravity feed systems and, at the same time, acts to exhaust any entrapped air in the product material to be compressed, practically eliminating tablet capping and laminating due to air entrapment which may occur with conventional prior art presses. Beneath each of the dies on the filling turntable is a filter, the underside of the filter being connected to a vacuum pump. Before each die filling operation, the filter material underneath each die is purged with compressed air to clear the filter and prevent it from being clogged. Vacuum-assisted filling of the dies also makes lower punch drop-away unnecessary, without puffing material out of the die as the upper punch enters, since essentially no air is introduced into the die cavity due to the fill level being flush with the top of each die.

Another important feature of the invention is the provision of means for injecting wall lubricant into each die before filling. This eliminates the requirement for mixing lubricant into the product to be compressed which, as explained above, is undesirable and sometimes affects the ultimate efficacy of the product. Furthermore, mixing a lubricant with the product material to be compressed usually requires more pressure from the press in order to form a cohesive tablet and increases the cost of the product because of the initial blending step required. Die wall lubricaton of this type also reduces wear between the punches and the dies and also is more effective in facilitating tablet release from the dies at the time of ejection, resulting in less wear and better tablet finish.

Instead of using cams for actuating the punches as in prior art machines, the present invention utilizes an inclined disc which rotates with the punches such that there is no relative movement between the punches and the disc. This reduces wear on both the actuating disc and the punches themselves.

The present invention also eliminates the need for die-lock screws required by prior art machines. The dies are carried in notches spaced around the peripheries of the turntables along with flexible restraining cords. The punches are held in the same manner. This reduces the wall contact in guiding punches, simplifies inspection, and facilitates the use of spray-dry lubricants or wet-atomized fog applied while the machine is in operation. Removing and replacing punches and dies requires only a fraction of the time required with prior art machines.

The above and other objects and features of the invention will become apparent from the following detailed description taken in connection with the accompanying drawings which form a part of this specification, and in which.

Figure 1:
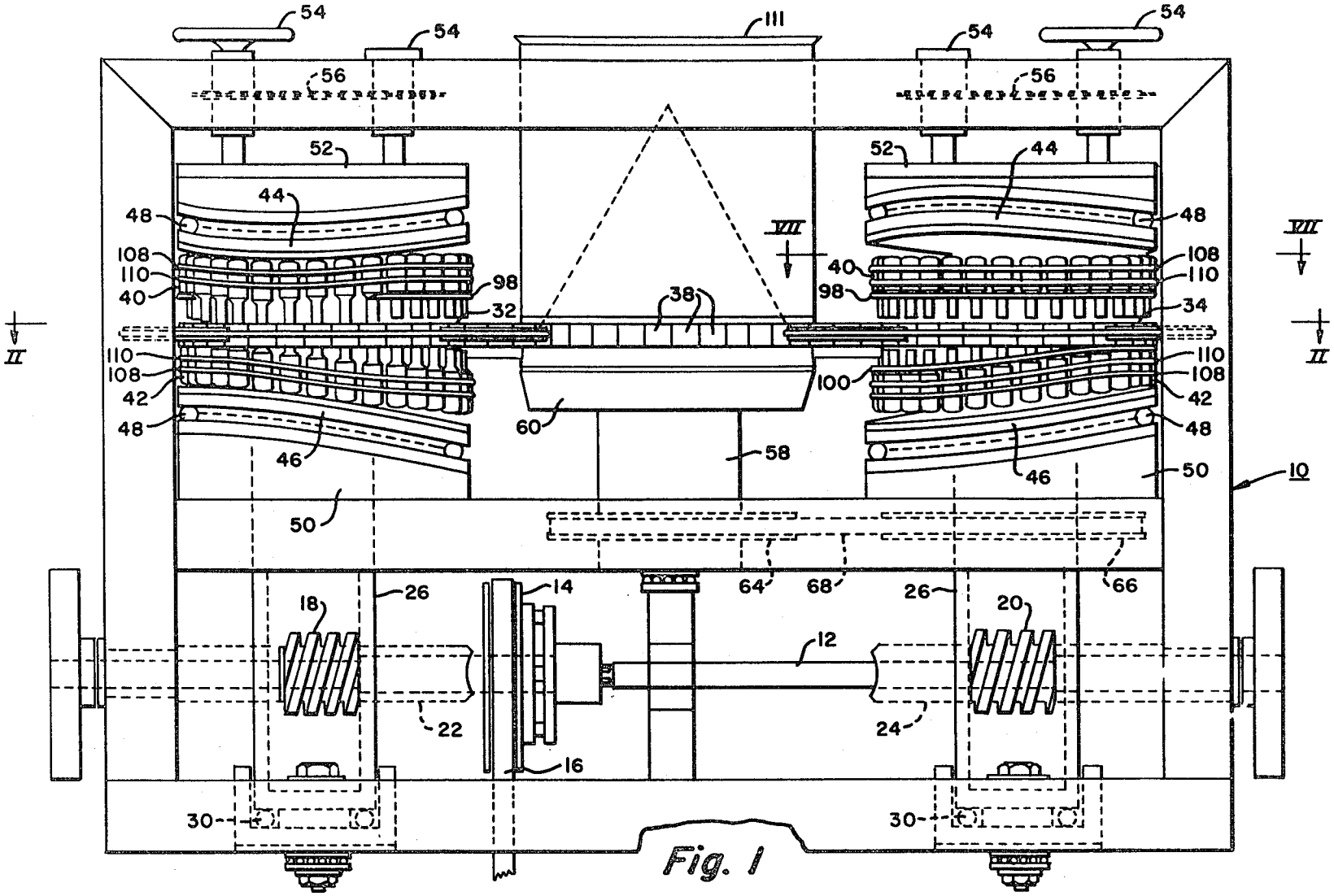
FIG. 1 is an elevational plan view of one embodiment of the invention which utilizes one filling turntable and two compression turntables.

With reference now to the drawings, and particularly to FIG. 1, the apparatus shown includes a frame 10 on which is mounted a main drive shaft 12 connected through a pulley 14 and drive belt 16 to a drive motor, not shown, mounted on the frame 10 beneath the apparatus shown in FIG. 1. Also mounted beneath the apparatus shown in FIG. 1 is a vacuum pump.

Figure 3:
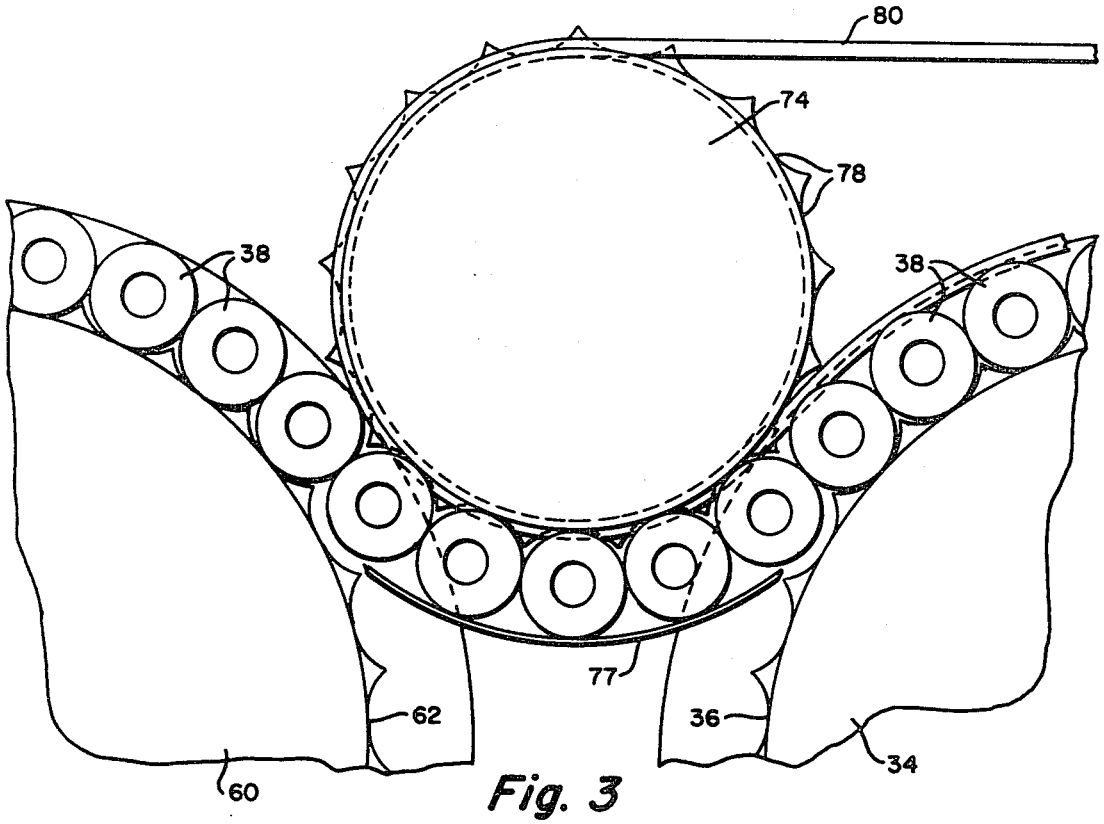
FIG. 3 is an enlarged cross-sectional view of the idler transfer mechanism of the invention.

Drive shaft 12 carries at its opposite ends worms 18 and 20 which mesh with worm gears 22 and 24 carried on vertical shafts 26 which are mounted in bearings 30 for rotation about parallel axes. The shafts 26, in turn, carry pressing turntables 32 and 34 which, as shown in FIG. 3, are provided with generally semicircular notches 36 which receive tablet-forming dies, generally indicated by the reference numeral 38. Above and below the dies 38 carried on the turntables 32 and 34 are upper and lower sets of punches 40 and 42, respectively, These are adapted to be guided vertically and horizontally by an arcuate vertical wall portion of their respective pressure tables 32 and 34. The lower ball bearing thrust discs 46 and 48 are carried on bearing block 50 supported by the frame 10 while the upper disc 44 is carried by a second bearing block 52 which can be adjusted upwardly or downwardly by screws 54 which are interconnected for synchronous movement by means of a chain 56.

Also carried on the frame 10 is a third upstanding shaft 58 which carries a die filling platform 60 having die-receiving notches 62 (FIGS. 2 and 3) which lie in essentially the same horizontal plane as the notches 36 which carry the dies 38 on the platforms 32 and 34. The shaft 58 is connected through pulleys 64 and 66 (FIG. 1) and belt 68 to the shaft 26. Pulleys 64 and 66 are proportioned such that the rotational speed of the turntable 60 is equal to that of the turntables 32 and 34, assuming that their diameters are the same. If the diameters of the turntables should not be the same, the dimensions of the pulleys 64 and 66 must be such that the circumferential speed of the platform 60 is equal to that of the platforms 32 and 34.

Figure 2:
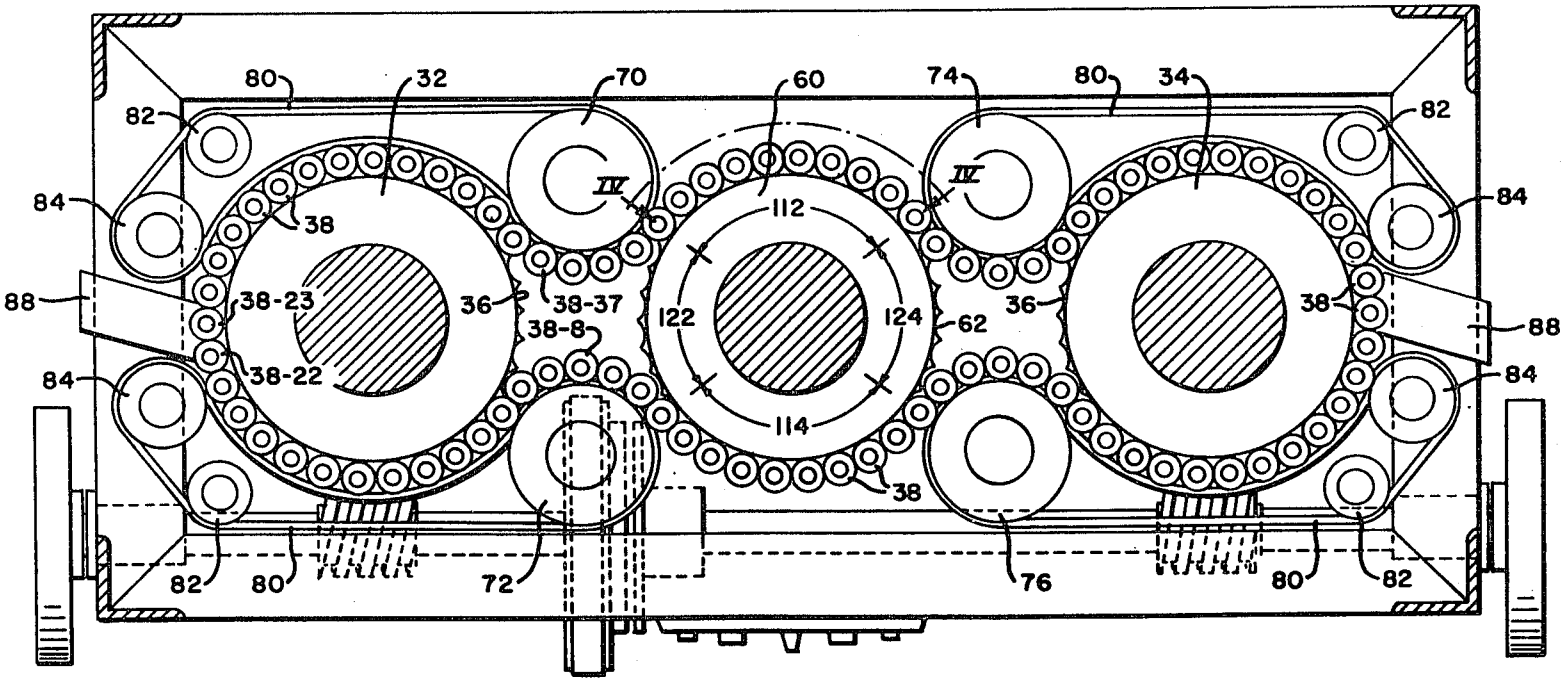
FIG. 2 is a cross-sectional view taken substantially along line II—II of FIG. 1.

With specific references to FIGS. 2 and 3, two idler wheels or sprockets 70 and 72 are disposed between the turntables 60 and 32. Similarly, idler wheels 74 and 76 are disposed between the turntables 60 and 34. The idler wheels 72 and 74 serve to transfer dies from the filling turntable 60 to the forming turntable 32 or 34, and 70 and 76 from forming to filling table 60. In this respect, it will be noted from an examination of FIG. 3 that when dies 38 on the turntable 60, for example, approach idler wheel 74 and are essentially tangential thereto, they engage an arcuate guide 77 which causes the dies to be transferred from the semicircular notches in turntable 60 to similar semicircular notches 78 in the idler wheel 74. They then travel around the axis of the idler wheel until they are picked up by the semicircular notches 36 in the turntable 34.

Figure 4:
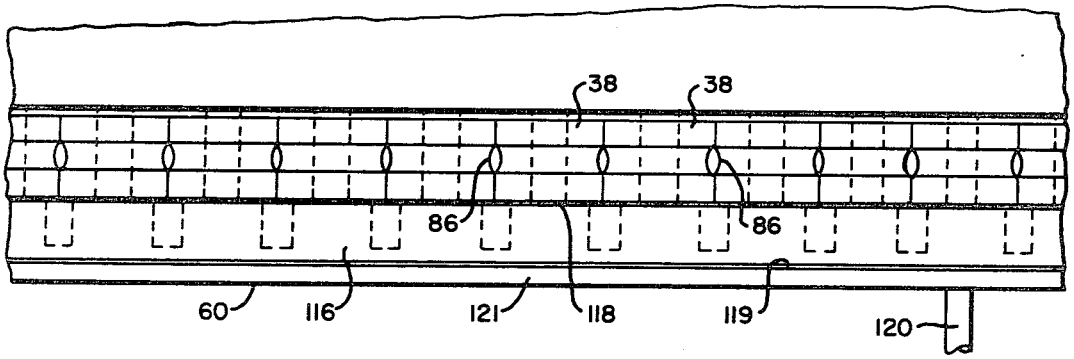
FIG. 4 is a cross-sectional view taken substantially along line IV—IV of FIG. 2 showing the manner in which a vacuum is created beneath the dies of the press during the filling operation.

Extending around the idler wheel 74 is a flexible band 80. As shown in FIG. 2, the band 80 passes around the idler wheel 74, then around the idler wheel 82 and the idler wheel 84 where it engages the peripheries of dies 38 carried on turntable 34. As shown in FIG. 4, the dies are provided with annular indentations or notches 86 into which the band 80 fits. This is perhaps best shown in FIG. 10. Similar bands 80 are provided for each of the three remaining idler wheels 70–76 as are idler wheels 82 and 84.

With the arrangement shown, it will be appreciated that if all of the turntables 32, 34 and 60 rotate in clockwise directions, dies on turntable 60 will be transferred by idler wheel 74 to turntable 34 where they are held in place within the semicircular indentations 36 by the flexible band 80 until they reach an eject chute 88 which guides them to the band 80 for idler wheel 76. At this point, they are held on the periphery of the turntable 34 until they reach the idler wheel 76 where they are transferred back to the filling turntable 60. Once on the filling turntable 60, they are filled with product material during their advance through an arc of approximately 110° where they engage the idler wheel 72 which transfers them to compression turntable 32 in the manner described above. The dies travel around turntable 32 in the same manner as they traveled around turntable 34 until they reach the idler wheel 70 where they are transferred to the filling turntable, filled with product material, and then advanced to the idler wheel 74, whereupon the cycle repeats. Thus, each die travels in succession around a continuous closed-loop path of travel; and during its travel in one complete cycle it is filled twice and a tablet is twice formed and ejected therefrom.

It will be appreciated that as the upper punches 40 travel around the axis of the turntable 32, they will engage the lower periphery of the disc 44, which forces them into the die cavities. Similarly, as the lower punches 42 travel around the periphery of the turntable 32, they will be engaged by an arcuate segment of the disc 46 to force them upwardly into die cavities.

Figure 5:
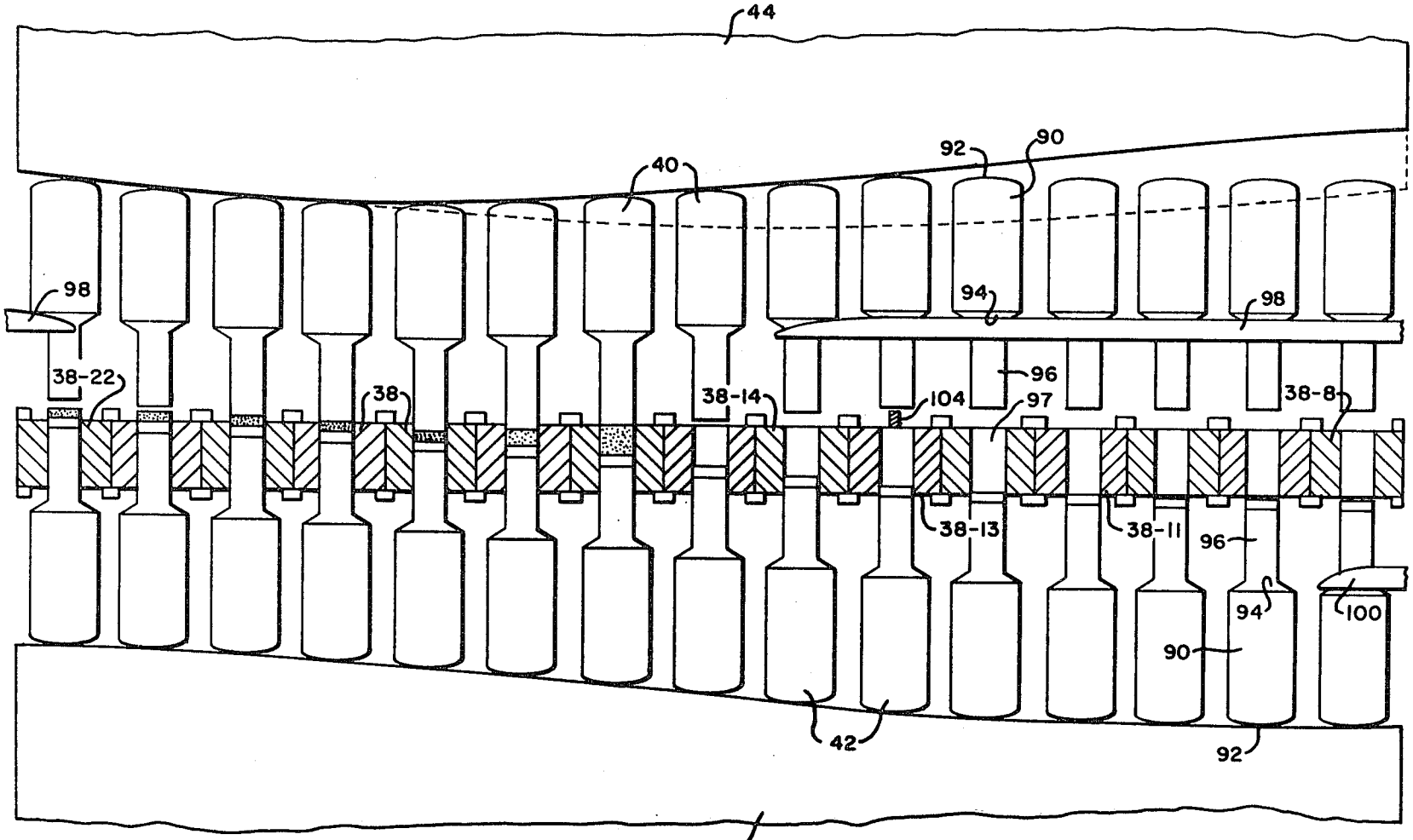
FIG. 5 is a timing diagram showing the positioning of the punches on a forming turntable during one-half revolution thereof.
Figure 6:
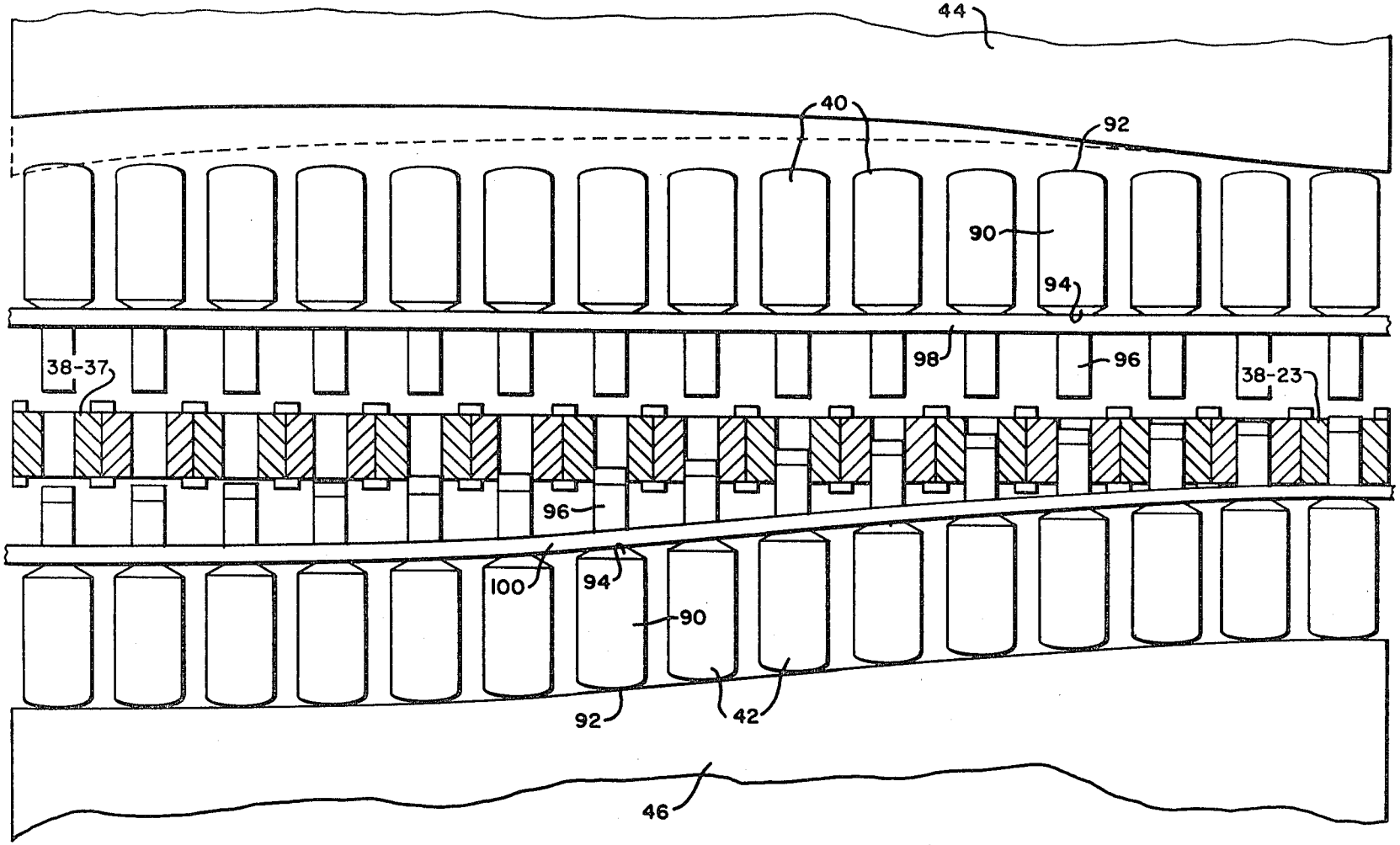
FIG. 6 is a timing diagram showing the positions of the punches on a forming turntable during the other half revolution thereof.

A timing diagram showing the positions of the punches 40 and 42 as they travel around the turntable 32, for example, is shown in FIGS. 5 and 6. It will be noted from FIG. 5 that each of the punches comprises an upper barrel portion 90 having a curved head surface 92 adapted to engage the lower periphery of the disc 44, and a tapered transition portion 94 which merges into a stem 96 adapted to enter the cavity 97 formed in each of the dies 38. For the purposes of explanation, and to correlate the relationship between the dies in FIGS. 2, 5 and 6, the first die at the right side of FIG. 5 is identified by the reference numeral 38-8. By reference to FIG. 2, it will be seen that this die is carried by the idler wheel 72 intermediate the turntables 60 and 32. Movement of the dies in FIGS. 5 and 6 is from right to left; and it will be noted that the die 38-22 shown in FIG. 5 is immediately adjacent the discharge chute 88 for the turntable 32. The positioning of the upper and lower punches 40 and 42 beyond the discharge chute is shown in FIG. 6 where die 38-23 at the right side of FIG. 6, is just past the discharge chute 88 and die 38-37 has been picked-up by the idler wheel 70. Extending around the punches 40 is an arcuate bar 98 which is adapted to engage the tapered portion 94 on each punch and hold it in an elevated position. Similarly, a second arcuate bar 100 extends around the lower punches 42 and is adapted to engage the tapered portion 94 on each of the lower punches 42 so as to pull it out of an associated die 38. As each punch is transferred from the idler wheel 72 to the turntable 32, for example its tapered portion 94 will engage the upper surface of the bar 98 such that it is held in an elevated position until it reaches the location of die 38-14 shown in FIG. 5, at which point the bar 98 terminates. At this point, the head 90 of each punch is engaged by the lower periphery of the disc 44. Thereafter, the upper punches 40 are forced downwardly into the cavities of the dies. At the same time, the lower punches 42, which are restrained by bar 100 at die location 38-8, are thereafter forced upwardly by the lower disc 46. At the approximate location of die 38-11 shown in FIG. 5, the die cavity, which is filled with product material, receives the shank portion 96 of a lower punch which continues upward movement to approximately die location 38-13. Near this point, an adjustable scraper bar 104 scrapes off any excess powder and insures that a predetermined product material charge exists in the die. Thereafter, the upper punches 40 begin their downward movement while the lower punches 42 continue to move upwardly to compress the product material into a tablet which is finally ejected at die location 38-22 and deflected onto the exit chute 88 by a scraper or other means, not shown. At this point, the upper punches 40 are engaged by the other end of bar 98 and held in their uppermost positions until they travel around the axis of the turntable (FIG. 6) to the location of die 38-14 shown in FIG. 5. At the same time, the lower punches 42 engage the bar 100 which curves downwardly so as to move the lower punches out of their associated die cavities preparatory to a succeeding compression stroke.

Figure 10:
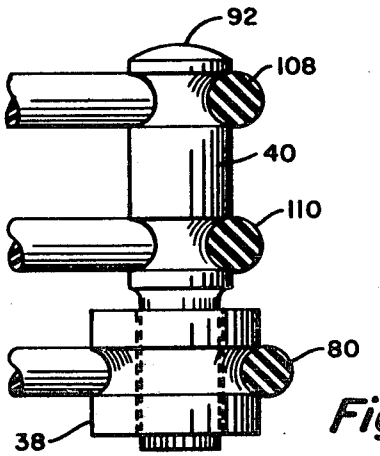
FIG. 10 is an enlarged view of the band-type restraining means for holding the dies and the punches on the peripheries of the forming turntables.
Figure 7:
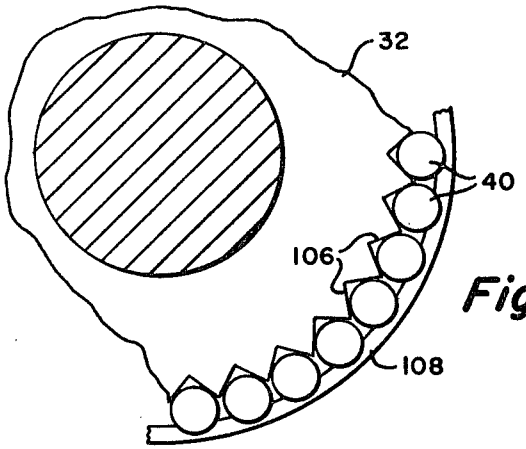
FIG. 7 is a cross-sectional view taken substantially along line VII—VII of FIG. 1 showing the manner in which the punches are held on the periphery of the forming turntables of the invention.

With reference to FIG. 7, it will be noted that the barrel portions 90 of the upper and lower punches are carried within V-shaped or semicircular slots 106 formed in the back-up wall of the turntable 32 or 34 and are held in place by means of elastic or the like bands 108 and 110, best shown in FIG. 10. The bands 108 and 110 do not leave the turntable 32 or 34 in contrast to the bands 80 which do and which engage the outer peripheries of the dies only as they move through a portion of the arcuate travel of an associated turntable. It can thus be appreciated that while dies being loaded on the turntable 60, tablets are being formed on each of the turntables 32 and 34 with a resultant high production rate.

Referring again to FIG. 1, above the filling turntable 60 is a rotating hopper 111 which contains material to be compressed and which has arcuate openings in its bottom surface extending approximately through the arcs 112 and 114 shown in FIG. 2. Beneath the arcuate portions 112 and 114, as best shown in FIG. 4, is a circular filter cavity 116 which rotates with turntable 60 and is bounded at the top and bottom by perforated stainless steel plates 118 and 119. Beneath the plate 119 is a stationary plenum chamber 121 connected to the aforesaid vacuum pump, not shown, through a conduit 120. As the lower stainless steel plate 119 moves over the stationary plenum chamber 121, any air within the die cavities is drawn downwardly through the filter cavity, thence to the vacuum pump. During this time, die cavities are being filled from the hopper 111 with product material; and since the die cavities are evacuated during the filling operation, filling occurs faster than when gravity alone is relied upon and most of the entrapped air in the product material to be compressed is exhausted. This substantially eliminates tablet capping and laminating and allows faster filling and compressing as explained above. The upper perforated stainless steel plate 118 will assist in retaining the major portion of the product material within the die cavities and act as wear plate support for the dies. However, some of the product material will inherently pass through the perforated stainless steel plate 118 and into the filter within cavity 116. Accordingly, in the arcuate portions 122 and 124 shown in FIG. 2, and beneath the rotating filter cavity 116, is a separate stationary segment for forcing compressed air upwardly through the filter and cavity 116, thereby purging it of any finer particles entrained therein during the vacuum-charging operation just described. This purged product will be drawn off by the vacuum from the above table at this point. Clogging of the filter is, therefore, eliminated. The means for forcing compressed air upwardly may, for example, comprise a simple jet manifold segment which forces air upwardly through the lower perforated stainless steel plate 119.

Figure 8:
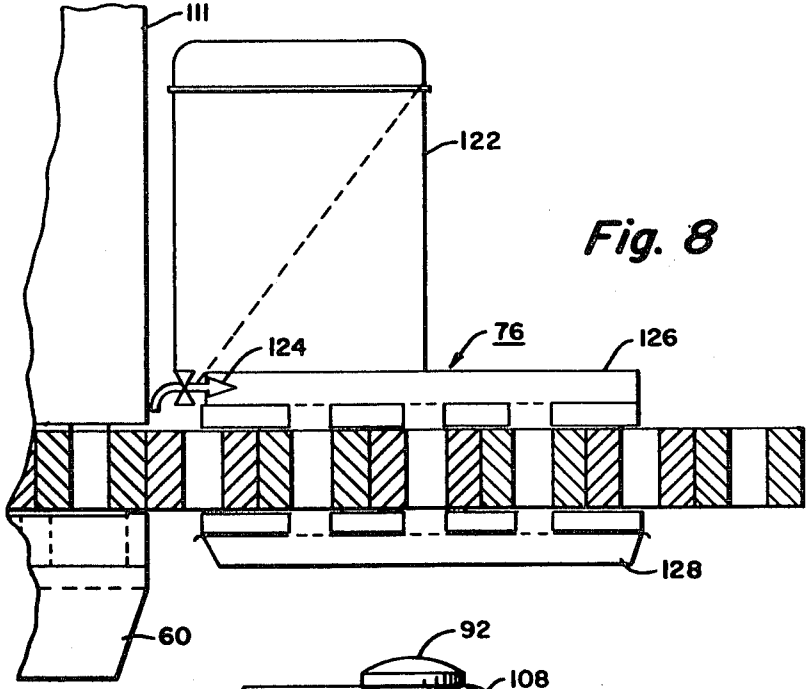
FIG. 8 is an illustration of one type of apparatus for lubricating the inner walls of die cavities.

It will be appreciated that as the dies travel around the axes of idler wheels 72 and 74, they are filled with product material to be compressed; while those traveling around idler wheels 70 and 76 are empty. As the dies travel around the wheel 70 or 76, their internal peripheries are lubricated by an arrangement such as that shown in FIG. 8 where the idler wheel 76 is shown. A hopper 122, filled with a dry fine powder lubricant, is disposed above each of the idler wheels 70 and 76 and is provided with a nozzle 124 which sprays the lubricant into a chamber 126 above each of the idler wheels 70 and 76. From chamber 126, the lubricant passes downwardly through the die cavities to a lower chamber 128 where it is exhausted or is otherwise recovered. Lubrication of the internal peripheries of the dies in this manner eliminates the necessity for mixing a lubricant with the product material to be compressed with all of its attendant difficulties, as explained above.

Figure 9:
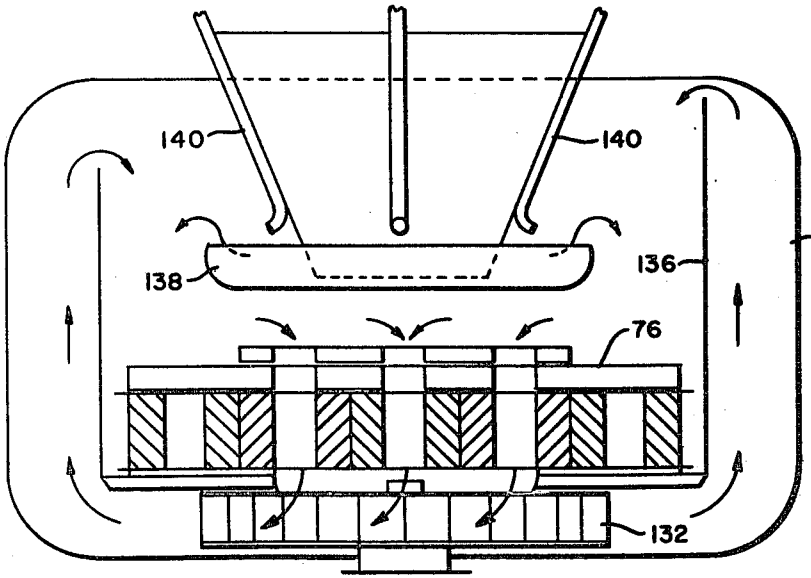
FIG. 9 is an illustration of an alternative embodiment of means for lubricating the internal walls of the dies.

An alternative embodiment for lubricating this die is shown in FIG. 9. In this case, the idler wheel 76, for example, can be enclosed within a casing 134. Beneath the idler wheel is a fan 132 which sucks air downwardly through the die cavities and returns it upwardly through an annular passageway 134 formed by annular wall 136 surrounding the idler wheel. After passing upwardly through the passageway 134, the air then moves downwardly; however as it moves downwardly it picks up lubricant from a trough 138 and carries it through the die cavities. If desired or necessary, an auxiliary jet source of air under pressure passing through the pipes 140 can be utilized to blow the atomized lubricant from the trough 138 and entrain it within the downwardly-moving air.

Although the invention has been shown in connection with a certain specific embodiment, it will be readily apparent to those skilled in the art that various changes in form and arrangement of parts may be made to suit requirements without departing from the spirit and scope of the invention. In this regard, it will be appreciated that a single forming turntable can be used with a single filling turntable; and that three or even four forming turntables can be spaced around a single filling turntable rather than the two shown herein.

What is claimed is:

1. In apparatus for compressing material into tablets, turntable means having means on its periphery for receiving dies which are to be filled with product material prior to compression, dies positioned in at least some of said receiving means, and apparatus for evacuating said dies as they are filled with said product, said apparatus for evacuating comprising a filter beneath said dies carried on said turntable and having a filtering surface in contact with the bottoms of the dies, said filtering surface preventing substantial product material from passing out of the dies, and means for evacuating the filter cavity.

2. The apparatus of claim 1 including porous membranes above and beneath the filter cavity, one of which may be said filtering surface.

3. The apparatus of claim 2 wherein said filter cavity rotates with said turntable.

4. The apparatus of claim 3 including means spaced from said means for evacuating around the periphery of said turntable, for forcing compressed air through said filter means to purge it of product material entrained therein.

5. In an apparatus for compressing product material into tablets having dies carried on a turntable and opposed punches dies positioned in at least some of said receiving means, between which opposed punches the product material is compressed to form tablets; the improvement of means positioned on said apparatus for evacuating said dies as they are filled with said product material during an interval when said punches are both removed from the die cavities, whereby filling occurs faster and more effectively than when gravity is relied upon, and entrapped air in the product material to be compressed is minimized for tablet improvement.

* * * * *